US008950412B2

(12) United States Patent
Ott

(10) Patent No.: US 8,950,412 B2
(45) Date of Patent: Feb. 10, 2015

(54) HAIR EXTENSION REMOVER

(75) Inventor: Gerhard Ott, Singapore (SG)

(73) Assignee: Hairdreams Haarhandels GmbH, Graz (AU)

( * ) Notice: Subject to any disclaimer, the term of this patent is extended or adjusted under 35 U.S.C. 154(b) by 253 days.

(21) Appl. No.: 13/511,753

(22) PCT Filed: Jul. 7, 2010

(86) PCT No.: PCT/AT2010/000249

§ 371 (c)(1),
(2), (4) Date: May 24, 2012

(87) PCT Pub. No.: WO2011/063434

PCT Pub. Date: Jun. 3, 2011

(65) Prior Publication Data

US 2012/0247248 A1 Oct. 4, 2012

(30) Foreign Application Priority Data

Nov. 26, 2009 (EP) ..... 09450225

(51) Int. Cl.
*A45D 7/02* (2006.01)
*A41G 5/00* (2006.01)
*A45D 44/00* (2006.01)

(52) U.S. Cl.
CPC ..... *A41G 5/0086* (2013.01); *A45D 44/00* (2013.01)
USPC ..... 132/212

(58) Field of Classification Search
CPC ..... A41G 5/0086; A45D 44/00; A45D 19/02; F16H 1/02; F16H 25/20; F16H 19/04; A16H 1/04
USPC ..... 132/212, 200, 201, 333, 271, 272, 53, 132/216, 217, 112, 108–111, 113, 114, 116, 132/119.1, 223, 224; 74/431, 424.71, 422; 81/338, 357, 358, 57.11; 7/129, 130, 7/132, 133, 158, 170; 269/67, 68, 202, 269/212, 227; 401/265, 9, 10, 292; 119/600, 602, 603, 608, 609, 611
See application file for complete search history.

(56) References Cited

U.S. PATENT DOCUMENTS 3,585,704 A * 6/1971 Schroeder ..... 29/235
D261,096 S * 10/1981 Petersen ..... D8/22

(Continued)

FOREIGN PATENT DOCUMENTS

EP 0563486 A1 10/1993
IT BO20080221 A1 10/2009

(Continued)

OTHER PUBLICATIONS

PCT International Search Report for International Patent Application No. PCT/AT2010/000249, mailed Dec. 27, 2010.

*Primary Examiner* — Vanitha Elgart
(74) *Attorney, Agent, or Firm* — Holland & Hart

(57) ABSTRACT

A hair extension remover, which comprises two crimping jaws, wherein one crimping jaw can be moved relative to the other with a drive. A liquid container that can be pressurized and that is in the form of a piston-cylinder unit, opens into the vicinity of the crimping jaws. In order to ensure exclusive linear motions, the drive of the crimping jaws and the pressurization of the piston-cylinder unit are each designed as a gear drive. Each gear drive can comprise either a gear rack having a pinion or a gear wheel segment, or a gear spindle having a movement nut. The two gear drives can be coupled in an adjustable and motion-transmitting manner.

14 Claims, 3 Drawing Sheets

(56) References Cited

U.S. PATENT DOCUMENTS

| | | | | | |
|---|---|---|---|---|---|
| 4,327,485 | A | * | 5/1982 | Rix | 29/751 |
| 5,059,050 | A | * | 10/1991 | Guglielmo | 401/171 |
| 5,472,654 | A | * | 12/1995 | Crawford | 264/163 |
| 5,911,225 | A | * | 6/1999 | Carty et al. | 132/119.1 |
| 6,135,124 | A | * | 10/2000 | Grant | 132/271 |
| 6,313,439 | B1 | * | 11/2001 | Fischbach et al. | 219/223 |
| 7,073,516 | B1 | * | 7/2006 | Beamen | 132/200 |
| 7,124,918 | B2 | * | 10/2006 | Rascoe | 223/48 |
| D555,832 | S | * | 11/2007 | Stotts | D28/10 |
| 2003/0131864 | A1 | | 7/2003 | Lu | |
| 2007/0125398 | A1 | * | 6/2007 | Johnson | 132/200 |
| 2008/0223388 | A1 | * | 9/2008 | Stotts | 132/200 |
| 2011/0203603 | A1 | * | 8/2011 | Stotts | 132/200 |

FOREIGN PATENT DOCUMENTS

| | | | |
|---|---|---|---|
| NL | 1030766 | C2 | 6/2007 |
| WO | 2005025368 | A2 | 3/2005 |
| WO | 2008112523 | A1 | 9/2008 |

* cited by examiner

HAIR EXTENSION REMOVER

TECHNICAL FIELD

The invention relates to a hair extension remover, which comprises two crimping jaws, wherein one crimping jaw can be moved relative to the other by means of a drive, and in the vicinity of which a pressurizable liquid container in the form of a piston-cylinder unit discharges.

BACKGROUND

Such type of unit became known with respect to the crimping jaws drive by the Italian patent application BO 2008 A 000221, published on Apr. 11, 2008, pursuant to which the drive of the crimping jaws is performed by means of an eccentric bolt driven by an electric motor, where said eccentric bolt transfers a linear motion onto one of the two crimping jaws by means of a connecting rod. In a unit pursuant to the Italian patent application that is on the market, the piston of the piston-cylinder unit is pressurized by means of a manual rope winch. For removing a strand of hair and/or a braid of hair, which is bonded onto the scalp hair with a thermoplastic connector for the purpose of extending the hair, the connector will be destroyed by the reciprocating movement of the crimping jaws, wherein for facilitating the detachment of the scalp hair a solvent and/or a softening agent can still be injected into the crimping gap by means of the piston-cylinder unit.

A disadvantage of the known unit are the drive concepts of the crimping jaws and of the piston-cylinder unit, particularly since imbalances are present in the former because of the eccentric crank drive mechanism, which would require the balancing of masses, but without this vibrations would arise in the hands of the operator, and in the latter of which the rope winch requires unpleasant and uncomfortable finger movements of the operator.

SUMMARY

The object of the invention is therefore a hair extension remover with improved drives compared to the prior art.

This object is achieved with a hair extension remover of the type mentioned at the outset according to the invention in that the drive of the crimping jaws and the pressurization of the piston-cylinder unit are respectively designed as pinion gear.

By providing two pinion gears it ensures that the required linear movements of one of the two crimping jaws and the piston of the liquid container can run without lateral components, so that the unit remains extensively quiet in the operator's hand during use.

A large range of pinion gear variants are available. Preferred is however, if at least one of the two pinion gears consists of a gear rack and pinion and/or a gear wheel segment, or if at least one of the two pinion gears consists of a gear spindle with a movement nut.

Particularly advantageous is an embodiment in which the two pinion gears are coupled in an adjustable movably coupled manner. Because then, the injection of the solvent into the crimping gap can be optionally done by correlation with the sequence of motions of the crimping jaws, such as one drop for every five up and down motions of the crimping jaws, or similar.

In that case, a separate actuation of the piston of the liquid container is therefore no longer required, which in turn represents a high degree of operational comfort.

In the following, the invention is more closely detailed by means of a schematic illustration of an embodiment in the drawing.

DETAILED DESCRIPTION

Figure 1:
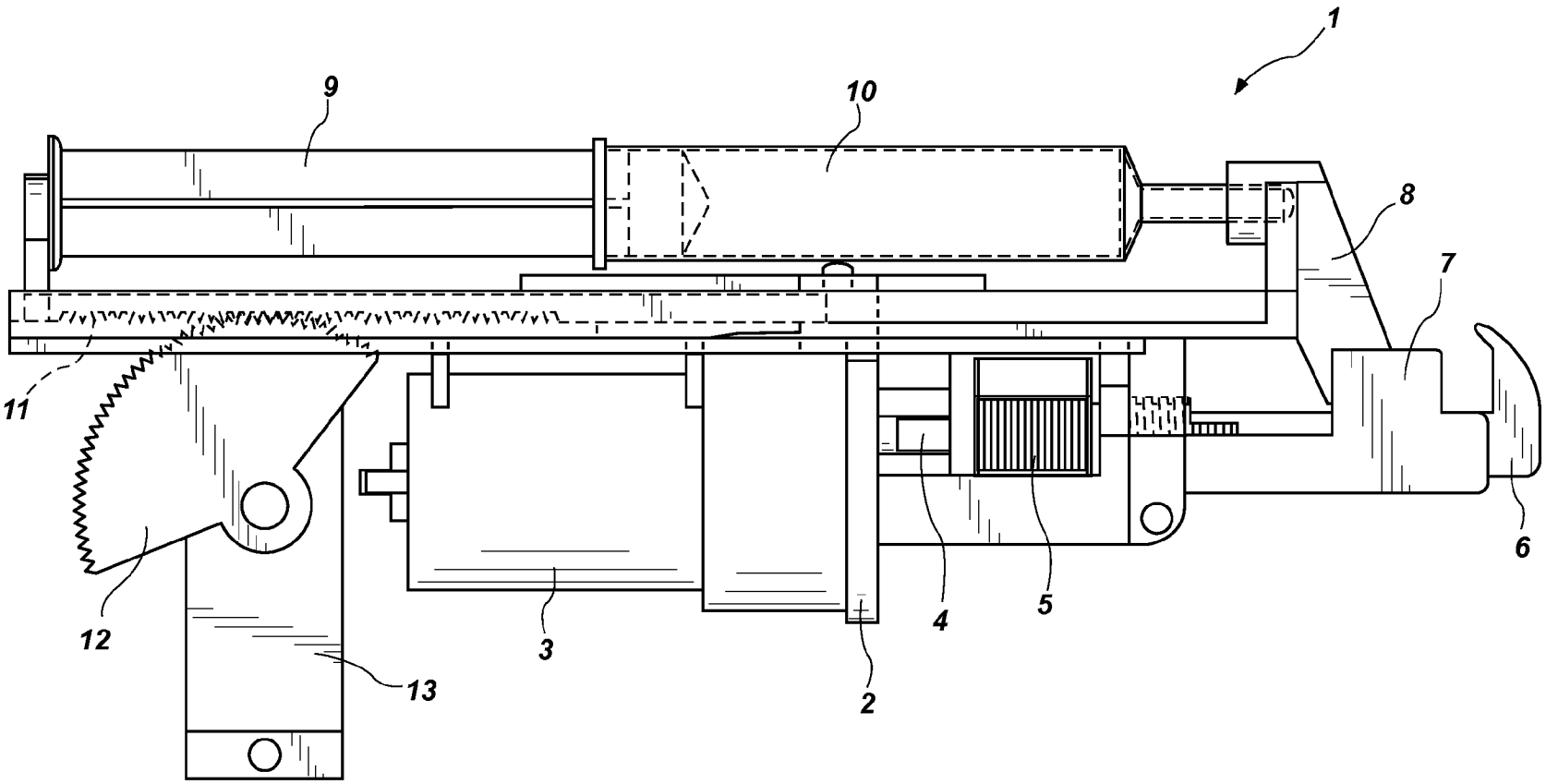
FIG. 1 is a schematic side view of the drive system of a hair extension remover as taught by the invention.
Figure 2:
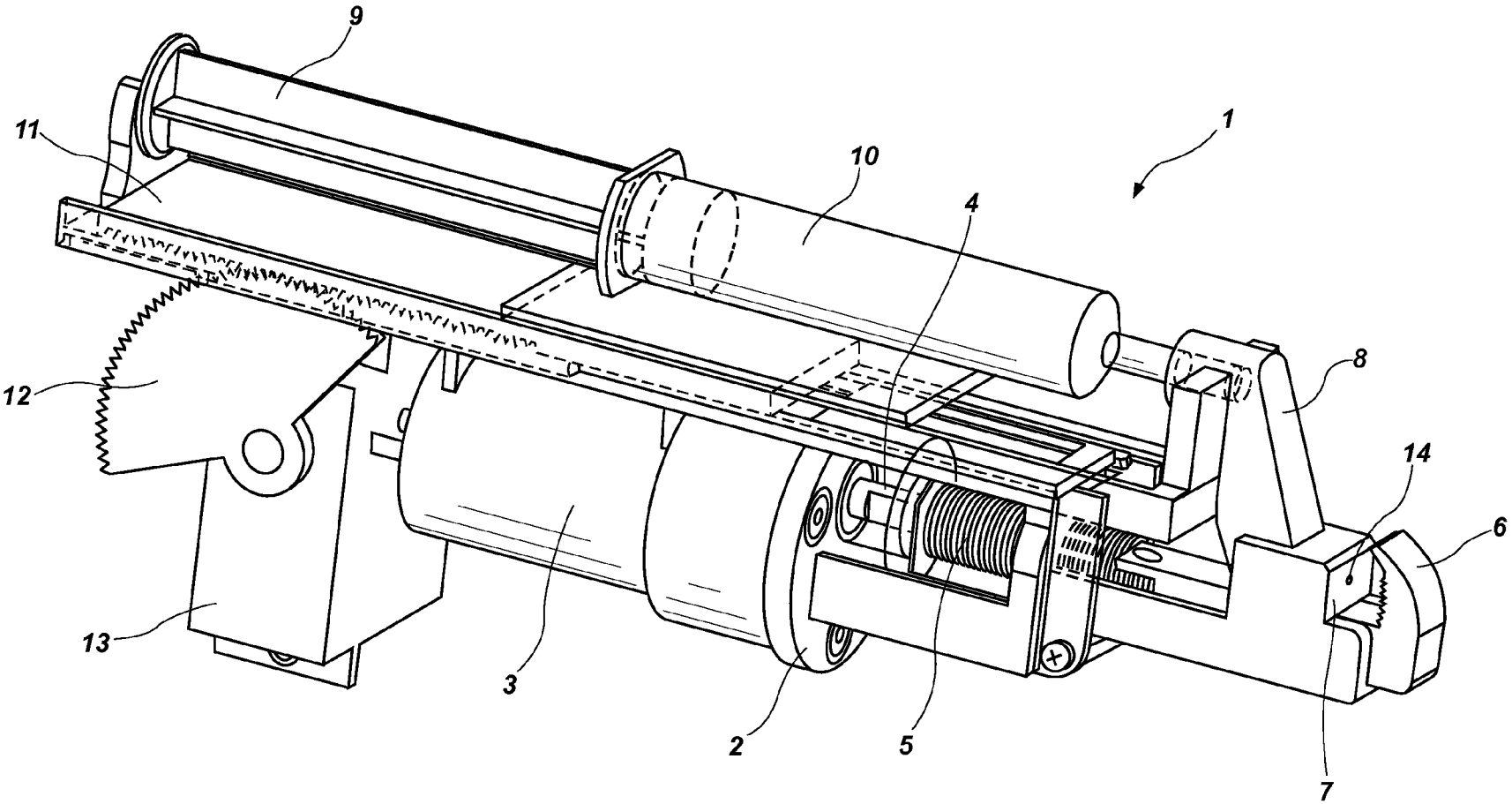
FIG. 2 shows the same hair extension remover in an oblique view from the front, where the crimping jaws are opened smallest.
Figure 3:
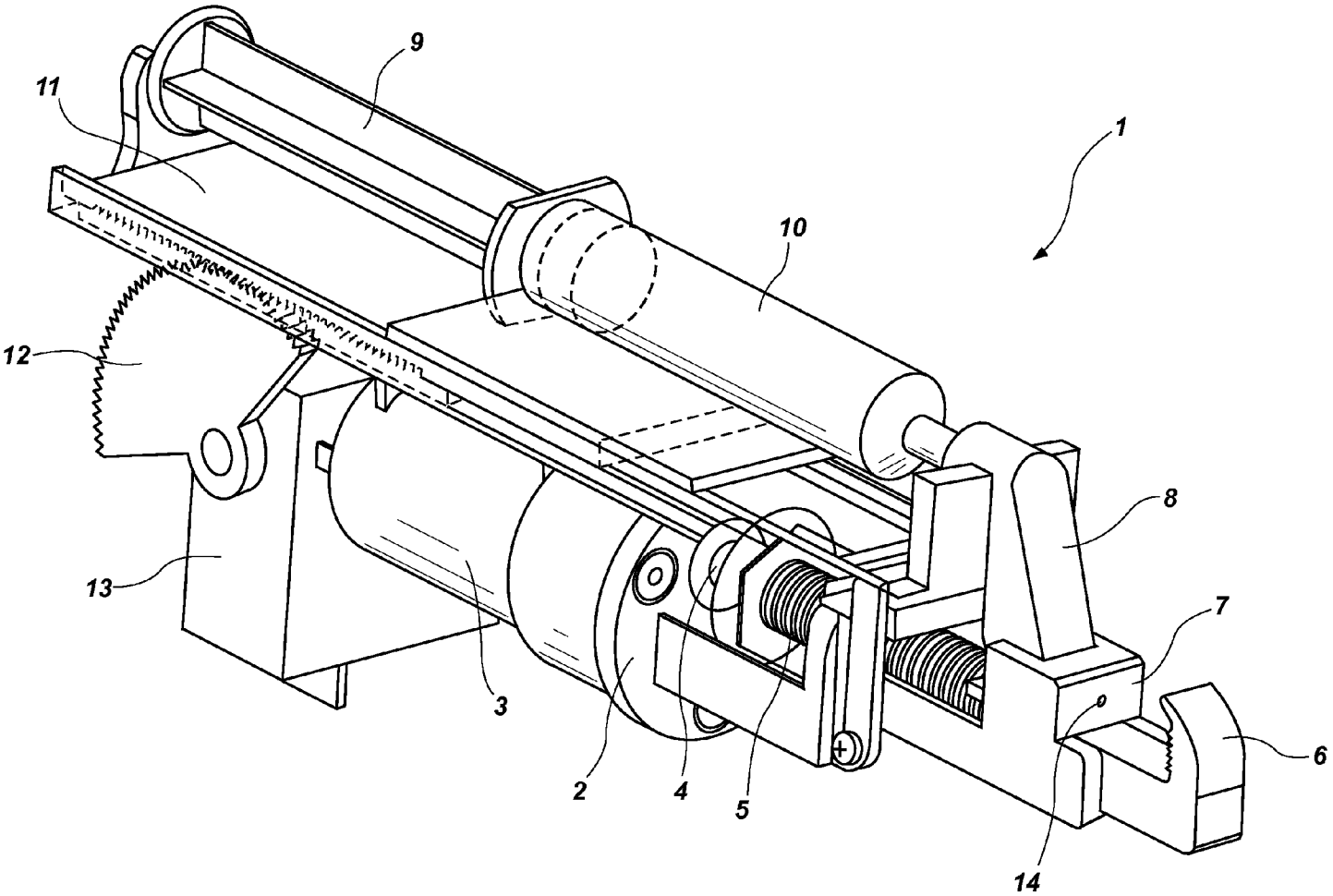
FIG. 3 shows the hair extension remover with the crimping jaws opened to the maximum.

The drive system of the hair extension remover 1 as taught by the invention is fitted in a housing (not shown) in the form of a pistol. An electric motor 3 mounted on a flange 2 drives a gear spindle 4 supported in the direction of the "pistol barrel," the movement nut 5 of which is connected with a movable crimping jaw 6, whereas the fixed crimping jaw 7 is firmly connected with the flange 2. A holder 8 for an insertable liquid container, which can be pressurized, in the form of a piston-cylinder unit 9, 10, designed as a syringe, for example, is attached above the electric motor 3 on the flange 2 and the fixed crimping jaw 7. In this context, the piston 9 is supported against a gear rack 11 which is angled on its rear end and which is displaceably guided on a holder 8, which is meshing with a gear wheel segment 12, which can be driven from a motor 13 which is housed in the "pistol grip." The cylinder 10, on the other hand, leads into a channel (not shown) in the holder 8, which leads into an opening 14 of the fixed crimping jaw 7 in the crimping gap.

The pinion gear of the crimping jaws 6, 7, which consists of the electric motor 3, the gear spindle 4 and the moving nut 5, and the pinion gear of the piston-cylinder unit 9, 10, consisting of the gear rack 11, the gear wheel segment 12 and the motor 13, can be adjusted in a movably coupled manner, such as by an electrical circuit (not illustrated). In this manner, the gear rack 11 can be advanced and therefore the entry of the piston 9 into the cylinder 10 can be selected depending upon the free movement of the crimping jaws 6, 7.

During the use of the hair extension remover as taught by the invention, the piston-cylinder unit 9, 10, filled with a solvent and/or softening agent is initially inserted into the holder 8, so that the piston 9 can support itself on the angled end of the gear rack 11. After introducing a connector (onto which one of the strands of hair serving for the hair extension has been bonded thermoplastically onto a scalp hair strand) into the gap between the two crimping jaws 6, 7, the electric motor 3 is actuated so that the movable crimping jaw 6 performs a reciprocal motion, as a result of which the connector is destroyed. In this context, the stroke length and the stroke position of the crimping jaw 6 can be adjusted beforehand for the purpose of adapting to the size of the respective connector. The rotation of the gear wheel segment 12 and therefore the advance of the gear rack 11 in relation to the intermittent movement of the crimping jaw 6 is likewise adjustable, as a result of which the solvent and/or softening agent located in the cylinder 10 can be dispensed through the opening 14 into the crimping gap in the desired dosage.

The hair extension remover just described can have innumerable modifications, without diverging from the scope of the invention. In place of the gear spindle 4 and the movement nut 5, a rack and pinion drive can also be provided. By the same token, the pressurization of the piston 9 would also be accomplished by a gear spindle/movement nut drive. An embodiment is furthermore possible in which only a single motor is provided and the adjustable coupling of motions of the two pinion gears is done by means of a transmission. Also the placement of the drives in the equipment housing can be varied, e.g. the motor 13 can also be located in the "pistol barrel" or the electric motor 3 can also be in the "pistol grip," wherein for this purpose adequate transmission elements are respectively required. Overall, the hair extension remover as taught by the invention has the advantage that during its use only the intermittent crimping motion, but not any lateral vibration movement is perceived in the operator's hand.

The invention claimed is:

1. A hair extension remover, comprising first and second crimping jaws and a pressurized liquid container mounted to a flange, the first crimping jaw being movable relative to the second crimping jaw with a first drive, and in the vicinity of which the pressurizable liquid container in the form of a piston-cylinder unit discharges by operation of a second drive, wherein the first and second drives include pinion gears.

2. The hair extension remover according to claim 1, wherein at least one of the pinion gears consists of a gear rack and pinion or a gear wheel segment.

3. The hair extension remover according to claim 1, wherein at least one of the pinion gears consists of a gear spindle with a movement nut.

4. The hair extension remover according to claim 1, wherein the pinion gears are movably coupled in an adjustable manner.

5. The hair extension remover according to claim 1, wherein the first crimping jaw maintains a fixed position, and the second crimping jaw is movable relative to the first crimping jaw.

6. The hair extension remover according to claim 1, wherein the piston-cylinder unit is configured as a syringe.

7. The hair extension remover according to claim 1, further comprising an electric motor configured to operate the first drive.

8. A hair extension remover, comprising:

a flange;

first and second crimping jaws mounted to the flange;

a first drive configured to move the second crimping jaw relative to the first crimping jaw;

a pressurizable liquid container in the form of a piston-cylinder unit that is configured to discharge in the vicinity of the crimping jaws by operation of a second drive, the pressurizable liquid container being mounted to the flange;

wherein the first and second drives each include pinion gears.

9. The hair extension remover according to claim 8, wherein at least one of the pinion gears consists of a gear rack and pinion or a gear wheel segment.

10. The hair extension remover according to claim 8, wherein at least one of the pinion gears consists of a gear spindle with a movement nut.

11. The hair extension remover according to claim 8, wherein the pinion gears are movably coupled in an adjustable manner.

12. The hair extension remover according to claim 8, wherein the first crimping jaw maintains a fixed position, and the second crimping jaw is movable relative to the first crimping jaw.

13. The hair extension remover according to claim 8, wherein the piston-cylinder unit is configured as a syringe.

14. The hair extension remover according to claim 8, further comprising an electric motor configured to operate the first drive.

* * * * *